US007172461B2

(12) United States Patent
Davis et al.

(10) Patent No.: US 7,172,461 B2
(45) Date of Patent: Feb. 6, 2007

(54) ELECTRICAL CONNECTOR

(75) Inventors: Wayne Samuel Davis, Harrisburg, PA (US); Robert Neil Whiteman, Jr., Middletown, PA (US); Douglas Wade Glover, Dauphin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/897,197

(22) Filed: Jul. 22, 2004

(65) Prior Publication Data

US 2006/0019538 A1 Jan. 26, 2006

(51) Int. Cl.
*H01R 13/648* (2006.01)

(52) U.S. Cl. ..... 439/608

(58) Field of Classification Search ..... 439/608, 439/941, 701, 609, 108
See application file for complete search history.

(56) References Cited

U.S. PATENT DOCUMENTS 5,066,236 A 11/1991 Broeksteeg ..... 439/79
6,123,586 A 9/2000 MacDougall ..... 439/701
6,386,924 B2 5/2002 Long ..... 439/701
6,540,559 B1 * 4/2003 Kemmick et al. ..... 439/608
6,575,789 B2 6/2003 Bassler et al. ..... 439/609
6,652,318 B1 11/2003 Winings et al. ..... 439/608
6,743,057 B2 * 6/2004 Davis et al. ..... 439/701
2003/0143894 A1 * 7/2003 Kline et al. ..... 439/608

* cited by examiner

*Primary Examiner*—Tulsidas C. Patel
*Assistant Examiner*—Phuongchi Nguyen

(57) ABSTRACT

An electrical connector is provided that includes a housing holding a plurality of contact modules. Each contact module contains a contact lead frame that includes signal leads and ground leads arranged in one of a first and second patterns. The first and second patterns each include pairs of signal leads and individual ground leads arranged in an alternating sequence. Each pair of signal leads is coupled to a ground lead in an adjacent contact module and the coupled ground lead in the adjacent contact module is substantially spacially centered between the pair of signal leads.

18 Claims, 9 Drawing Sheets

ELECTRICAL CONNECTOR

BACKGROUND OF THE INVENTION

The invention relates generally to electrical connectors and, more particularly, to an electrical connector for transmitting signals in differential pairs.

With the ongoing trend toward smaller, faster, and higher performance electrical components such as processors used in computers, routers, switches, etc., it has become increasingly important for the electrical interfaces along the electrical paths to also operate at higher speeds and at higher densities.

In a traditional approach for interconnecting circuit boards, one circuit board serves as a back plane and the other as a daughter board. The back plane typically has a connector, commonly referred to as a header, that includes a plurality of signal pins or contacts which connect to conductive traces on the back plane. The daughter board connector, commonly referred to as a receptacle, also includes a plurality of contacts or pins. Typically, the receptacle is a right angle connector that interconnects the back plane with the daughter board so that signals can be routed between the two. The right angle connector typically includes a mating face that receives the plurality of signal pins from the header on the back plane, and contacts that connect to the daughter board.

At least some board-to-board connectors are differential connectors wherein each signal requires two lines that are referred to as a differential pair. For better performance, a ground contact is associated with each differential pair. The receptacle connector typically includes a number of modules having contact edges that are at right angles to each other. The modules may or may not include a ground shield. As the transmission frequencies of signals through these connectors increase, it becomes more desirable to balance the impedance between contacts to minimize signal degradation. A ground shield is sometimes provided on the module to reduce interference or crosstalk. In addition, a ground shield may be added to the ground contacts on the header connector. Improving connector performance and increasing contact density to increase signal carrying capacity without increasing the size of the connectors is challenging.

Some older connectors, which are today's legacy connectors, operate at speeds of one gigabit per second or less. By contrast, many of today's high performance connectors are capable of operating at speeds of up to ten gigabits or more per second. As would be expected, the higher performance connector also comes with a higher cost.

A need remains for a low cost differential connector that provides a high density of interconnections and delivers adequate electrical performance at a reasonable cost.

BRIEF DESCRIPTION OF THE INVENTION

In one aspect, an electrical connector is provided that includes a housing holding a plurality of contact modules. Each contact module contains a contact lead frame that includes signal leads and ground leads arranged in one of a first and second patterns. The first and second patterns each include pairs of signal leads and individual ground leads arranged in an alternating sequence. Each pair of signal leads is coupled to a ground lead in an adjacent contact module and the coupled ground lead in the adjacent contact module is substantially spacially centered between the pair of signal leads.

Optionally, at least one lead of one of the pair of signal leads includes a jog so that a length of the one lead of the pair of signal leads is approximately equal to a length of the other of the pair of signal leads. At least one of the ground leads includes a jog that is configured to allow the at least one ground lead to be positioned such that the at least one ground lead minimizes an imbalance with a signal pair in an adjacent one of the plurality of contact modules.

In another aspect, an electrical connector is provided that includes a housing holding a plurality of contact modules, and wherein said housing and each of said plurality of contact modules cooperate to constrain said plurality of contact modules to be installed in said housing in a predetermined order.

In another aspect, an electrical connector is provided that includes a housing holding a plurality of contact modules that each contains a contact lead frame. The housing includes a plurality of latch hooks and each contact module includes a latch pocket. Each latch hook is received in a latch pocket of a respective contact module when the contact module is received in the housing. The latch hook and the latch pocket cooperate to retain the contact module in the housing and to inhibit the removal of an adjacent contact module from the housing.

DETAILED DESCRIPTION OF THE INVENTION

Figure 1:
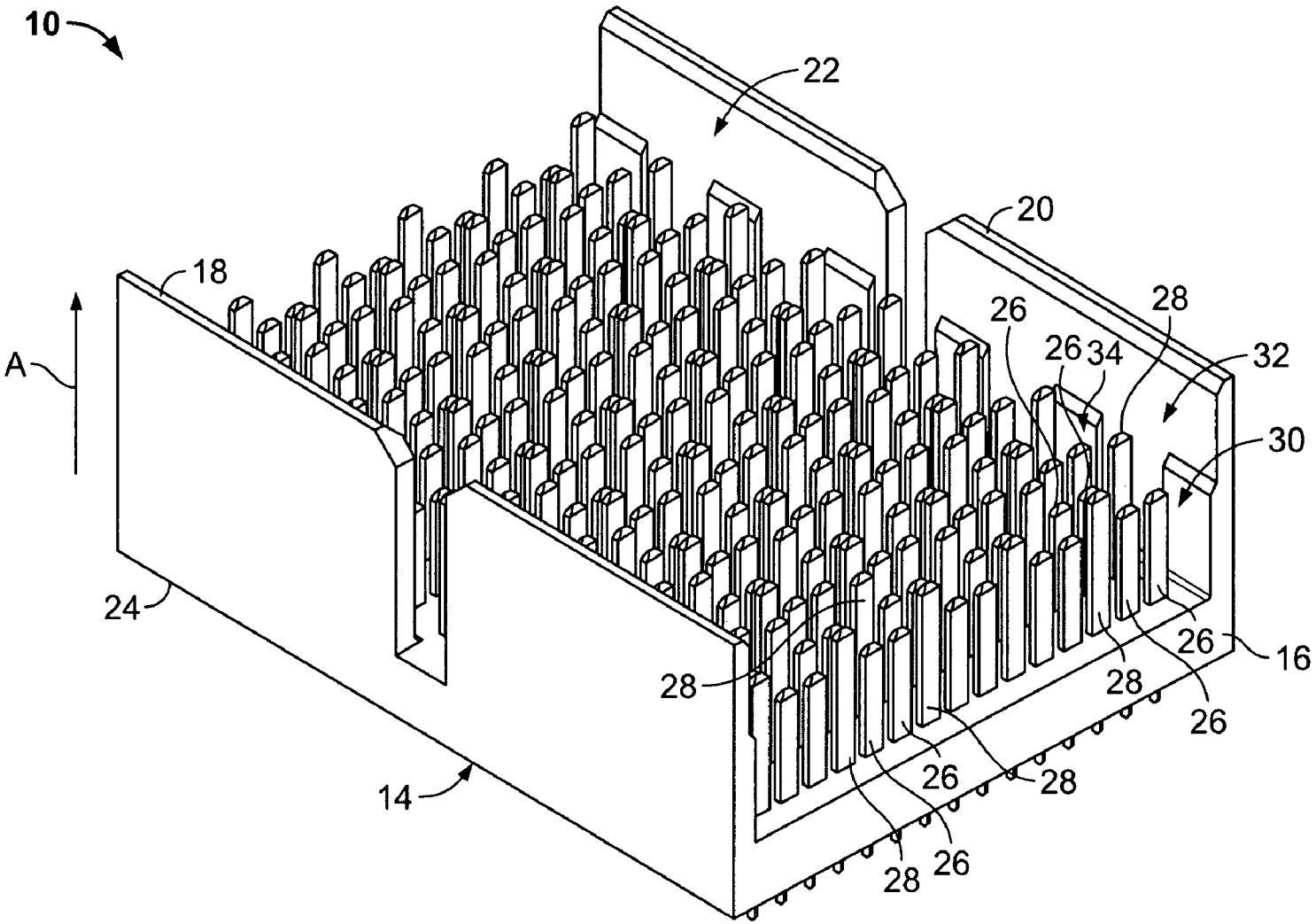
FIG. 1 is a perspective view of a header connector formed in accordance with an exemplary embodiment of the present invention.

FIG. 1 illustrates a perspective view of an electrical connector 10 formed in accordance with an exemplary embodiment of the present invention. The connector 10 is a header connector that is configured to be mounted on a circuit board (not shown). The connector 10 includes a dielectric housing 14 having a base 16 and upper and lower shrouds 18 and 20, respectively. The connector 10 includes a mating face 22 and a mounting face 24 that interfaces the circuit board. The connector 10 also holds an array of electrical contacts, some of which are signal contacts 26 and others of which are ground contacts 28.

Figure 3:
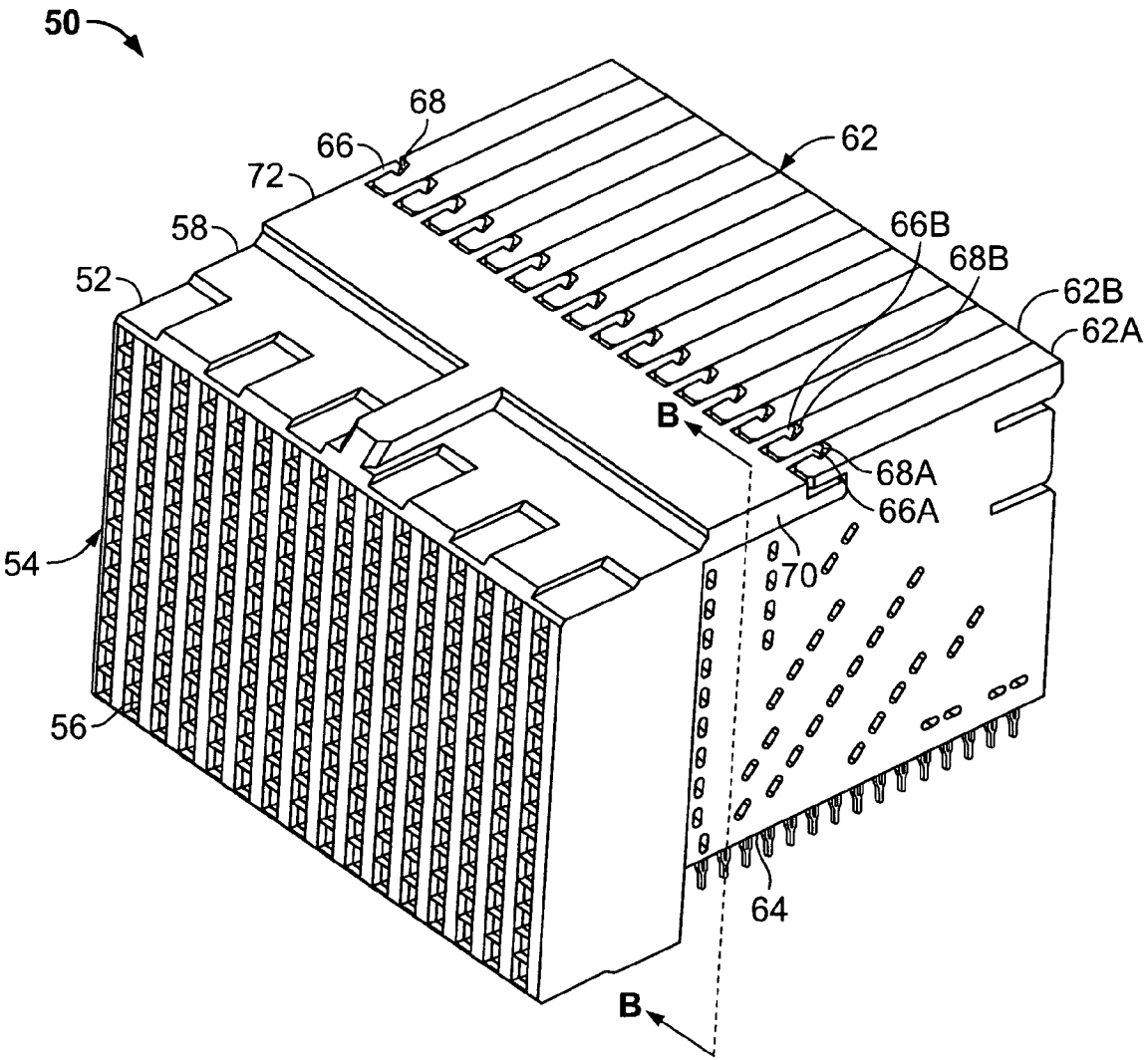
FIG. 3 is a perspective view of a receptacle connector formed in accordance with an exemplary embodiment of the present invention.

The ground contacts 28 are longer than the signal contacts 26 so that the ground contacts 28 are the first to mate and last to break when the header connector 10 is mated and separated, respectively, with a mating connector 50 (see FIG. 3). The contacts 26 and 28 are arranged in columns including pairs of signal contacts 26 and individual ground contacts 28 arranged in an alternating sequence. In one embodiment, the pairs of signal contacts 26 carry signals in a differential pair. The contacts 26, 28 in each column are arranged in one of a first or second pattern wherein pairs of signal contacts 26 are separated by individual ground contacts 28. The patterns alternate from column to column such that adjacent columns are arranged in different patterns while every other column exhibits the same pattern. For instance, the first column 30, is in a first pattern and begins with a pair of signal contacts 26 followed by a ground contact 28. The second column 32 is in a second pattern and begins with a ground contact 28 followed by a pair of signal contacts 26. Column 34 has the same pattern as column 30, and so on. In other words, the contact patterns from column to column, as in column 30 to column 32, are similar but offset with respect to one another.

As shown in FIG. 1, each contact column 30, 32 includes five pair of signal contacts 26 and five individual ground contacts 28. It is to be understood, however that in alternative embodiments, a greater or fewer number of pairs of signal contacts 26 and individual ground contacts 28 may be present. The ground contacts 28 are similar in profile to the signal contacts. Having no special features not shared with the signal contacts 26, the ground contacts 28 and signal contacts 26 can be spaced closer together so that the contact density in the connector 10 can be increased. In one embodiment, the connector 10 has a contact centerline spacing of 1.9 millimeters. However, in alternative embodiments other contact spacings may be used. By virtue of a small contact spacing, however, the connector 10 has increased signal carrying capacity without an increase in the overall size of the connector 10. Thus, a cost effective high density header connector (10) is provided that delivers adequate performance at acceptable noise levels.

Figure 2:
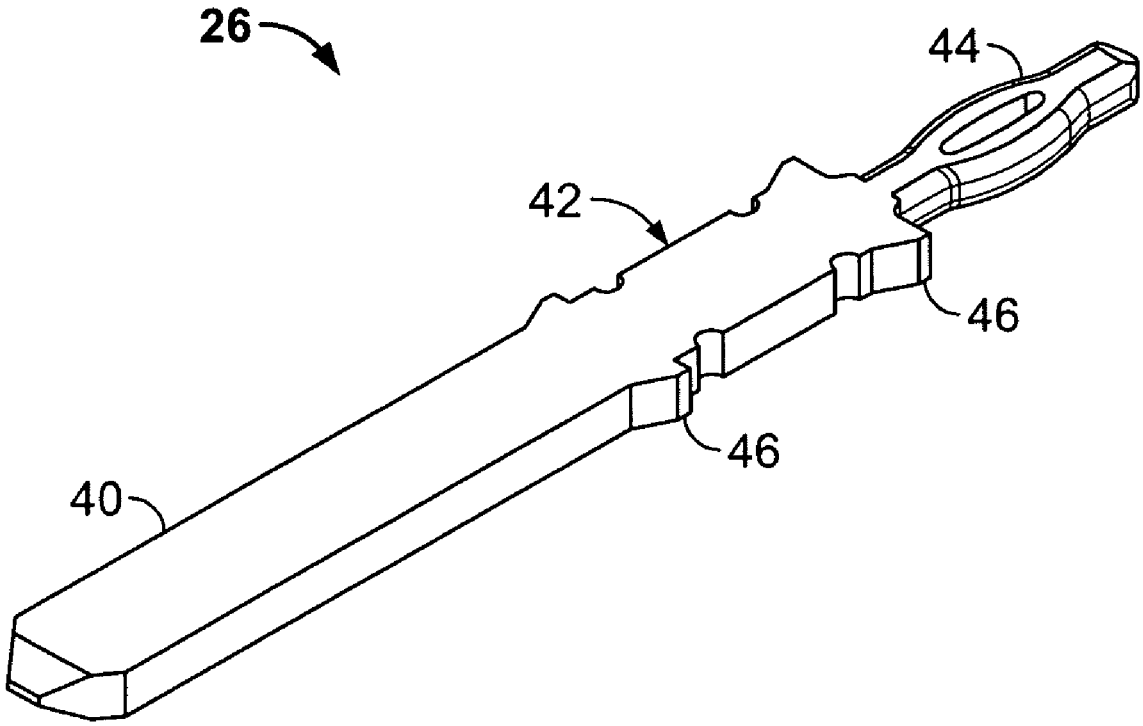
FIG. 2 is a perspective view of a contact for the header connector shown in FIG. 1.

FIG. 2 illustrates an exemplary signal contact 26 which may be used, for example, in the header connector 10 (shown in FIG. 1). The contact 26 includes a blade section 40, a body portion, 42 and a tail portion 44. The blade section 40 is configured to be matable with contacts in a mating connector 50 (see FIG. 3). The body portion 42 is press fitted into the base 16 of the connector 10 (FIG. 1). The body portion 42 includes retention barbs 46 that retain the contact 26 in the base 16. The tail portion 44 is used for mounting the connector 10 to the circuit board (not shown). In an exemplary embodiment, the tail portion 44 is a compliant eye of the needle design. The ground contacts 28 (shown in FIG. 1) have a longer blade section 40, measured in the direction of arrow A, than the signal contacts 26, but are substantially identical in all other respects.

FIG. 3 illustrates a perspective view of a receptacle connector 50 formed in accordance with an exemplary embodiment of the present invention. The receptacle connector 50 includes a dielectric housing 52 having a mating face 54 that includes a plurality of contact channels 56. The contact channels 56 are configured to receive mating contacts 26, 28 (FIG. 1) from a mating header connector such as the header connector 10 shown in FIG. 1. The receptacle connector 50 also includes an upper shroud 58 that extends rearwardly from the mating face 54. The housing 52 receives a plurality of contact modules 62 holding contacts and conductive paths that connect a mounting face 64 with the mating face 54. In an exemplary embodiment, the mounting face 64 is substantially perpendicular to the mating face 54 such that the receptacle connector 50 interconnects electrical components that are substantially at a right angle to each other.

The contact modules 62 include two module types, 62A and 62B. The modules 62A and 62B include contacts and electrical paths in patterns corresponding to the patterns of the contacts 26, 28 (FIG. 1) of the header connector 10. The contact modules 62A and 62B are loaded in an alternating sequence into the housing 52. More particularly, the contact modules 62A and 62B are loaded into the housing 52 in a predetermined order. The shroud 58 on the housing 52 includes a plurality of latch hooks 66, one at each contact module location. Each contact module 62A, 62B includes a latch pocket 68. Each latch hook 66 is received in a latch pocket 68 of a respective contact module 62A, 62B when the contact modules 62A, 62B are installed or received in the housing 52. The latch hook 66, when received in the latch pocket 68 retains the contact module 62A, 62B in the housing 52. Further, when the contact module 62B is received in the housing 52, the contact module 62B blocks the movement of the latch hook 66A such that the latch hook 66A is inhibited from moving out of the latch pocket 68A. Consequently, once contact module 62B is installed, the prior adjacent contact module 62A can neither be installed nor removed from the housing 52. Thus, the contact modules are constrained to be installed in the housing 52 in a predetermined order, starting from a first side 70 of the housing 52 to a second side 72 of the housing 52. For each contact module 62A, 62B, the latch hooks 66 and latch pockets 68 cooperate to retain the contact module 62A, 62B in the housing 52. Once each contact module 62A, 62B is installed, the installation of a prior adjacent contact module 62A, 62B is prevented. The latch hooks 66 and latch pockets 68 also cooperate to inhibit the removal of the prior adjacent contact module 62A, 62B.

Figure 4:
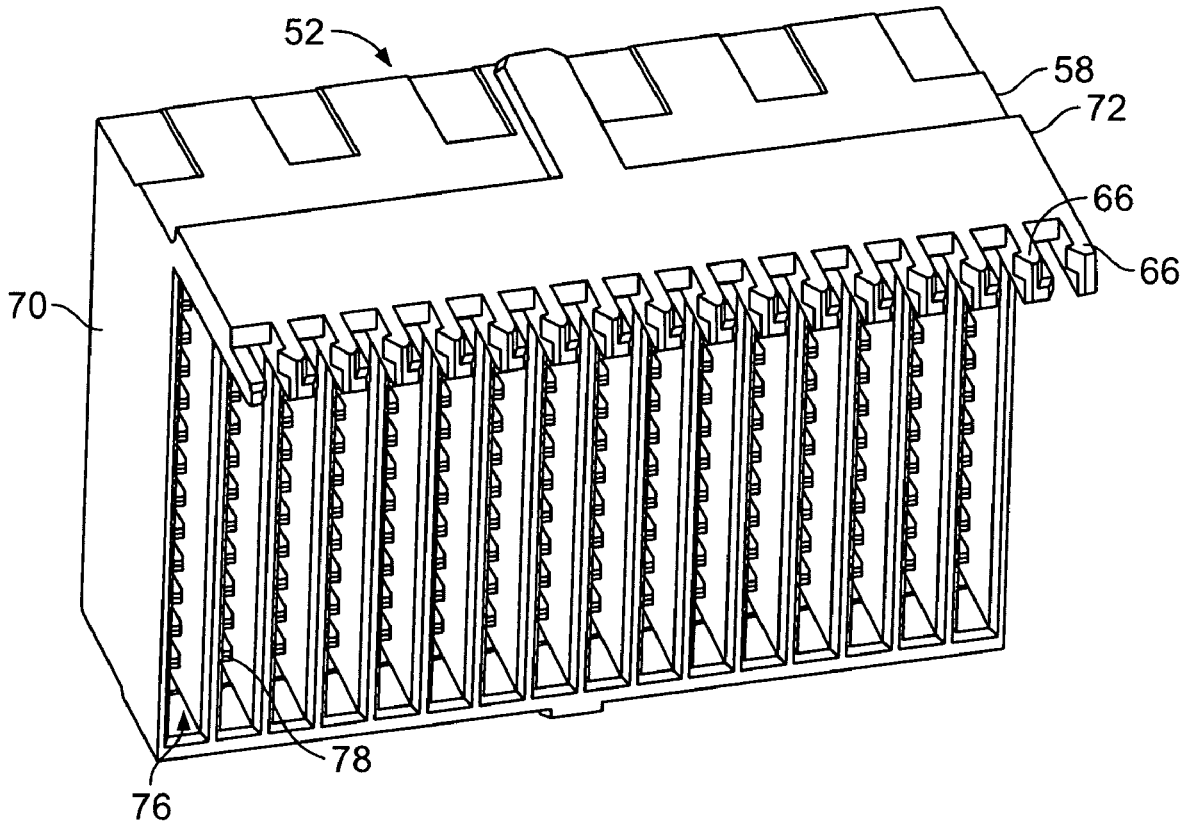
FIG. 4 is a rear perspective view of the housing of the receptacle connector shown in FIG. 3.

FIG. 4 is a rear perspective view of the housing 52. The housing 52 includes a plurality of chambers 76 that receive a forward mating end of each contact module 62A, 62B. The chambers 76 include a plurality of webs 78 that separate the contacts at the mating end 84 (see FIG. 5) of the contact modules 62A and 62B from one another. The chambers 76 restrict movement of the mating end 84 of the contact modules 62A, 62B when the contact modules 62A, 62B are loaded into the housing 52.

Figure 5:
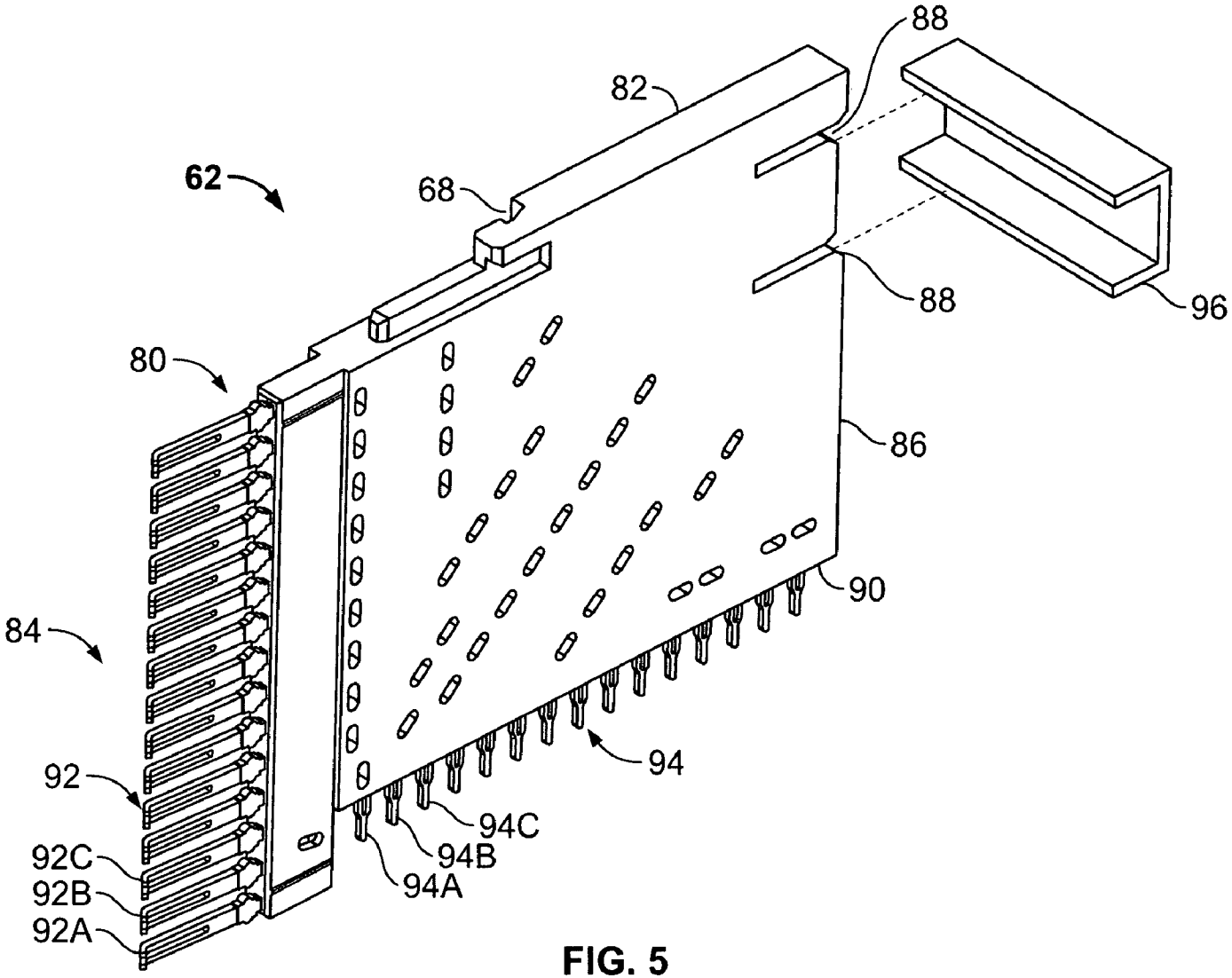
FIG. 5 is a perspective view of a contact module formed in accordance with an exemplary embodiment of the present invention.

FIG. 5 illustrates a perspective view of a contact module 62 formed in accordance with an exemplary embodiment of the present invention. The contact module 62 includes a contact lead frame 80 (see FIG. 6) that is overmolded and encased in a contact module housing 82 fabricated from a dielectric material. The contact module 62, including the contact lead frame 80, has a forward mating end 84 that is received in the chambers 76 (FIG. 4) of the receptacle connector housing 52 and an opposite rearward end 86 that includes slots 88. In one embodiment, the slots 88 in the rearward end 86 are configured to receive a tie bar 96 to align and couple the contact modules 62 together. In one embodiment, the tie bar 96 is U-shaped, although other geometries may also be used. A mounting edge 90 extends substantially perpendicular to the mating end 84. Mating contacts 92 extend from the mating end 84 and are configured to mate with the contacts 26, 28 in the header connector 10. Contact tail portions 94 extend from the mounting edge 90 of the contact module 62 for attachment to a circuit board or other electrical component. In an exemplary embodiment, the receptacle connector 50 and the header connector 10 interconnect circuit boards which are positioned at a right angle relative to one another such as a daughter board and a back plane. Optionally, the header and receptacle connectors 10 and 50 respectively can be used to interconnect components that are not both circuit boards.

As with the header contacts 26, 28, the mating contacts 92 are arranged in a column in one of a first or second patterns and the mating contacts 92 in adjacent contact modules are arranged in a different one of the first and second patterns. Both patterns includes pairs of signal contacts alternated with individual ground contacts. In an exemplary embodiment, the contact module 62 does not include a ground shield plate, and therefore separate ground leads are provided on each contact lead frame 80. In FIG. 5, the contacts 92A and 92B can be signal contacts and the contact 92C can be a ground contact, constituting a first pattern. Alternatively, the contact 92A can be a ground contact, and if so, the contacts 92B and 92C are signal contacts, constituting the second pattern. In each contact module, the pattern of the mounting contacts 94 matches that of the mating contacts 92. That is, mounting contact 94A is the mounting end of the mating contact 92A, and likewise, mounting contacts 94B and 94C are the mounting ends of the mating contacts 92B and 92C respectively.

Figure 6:
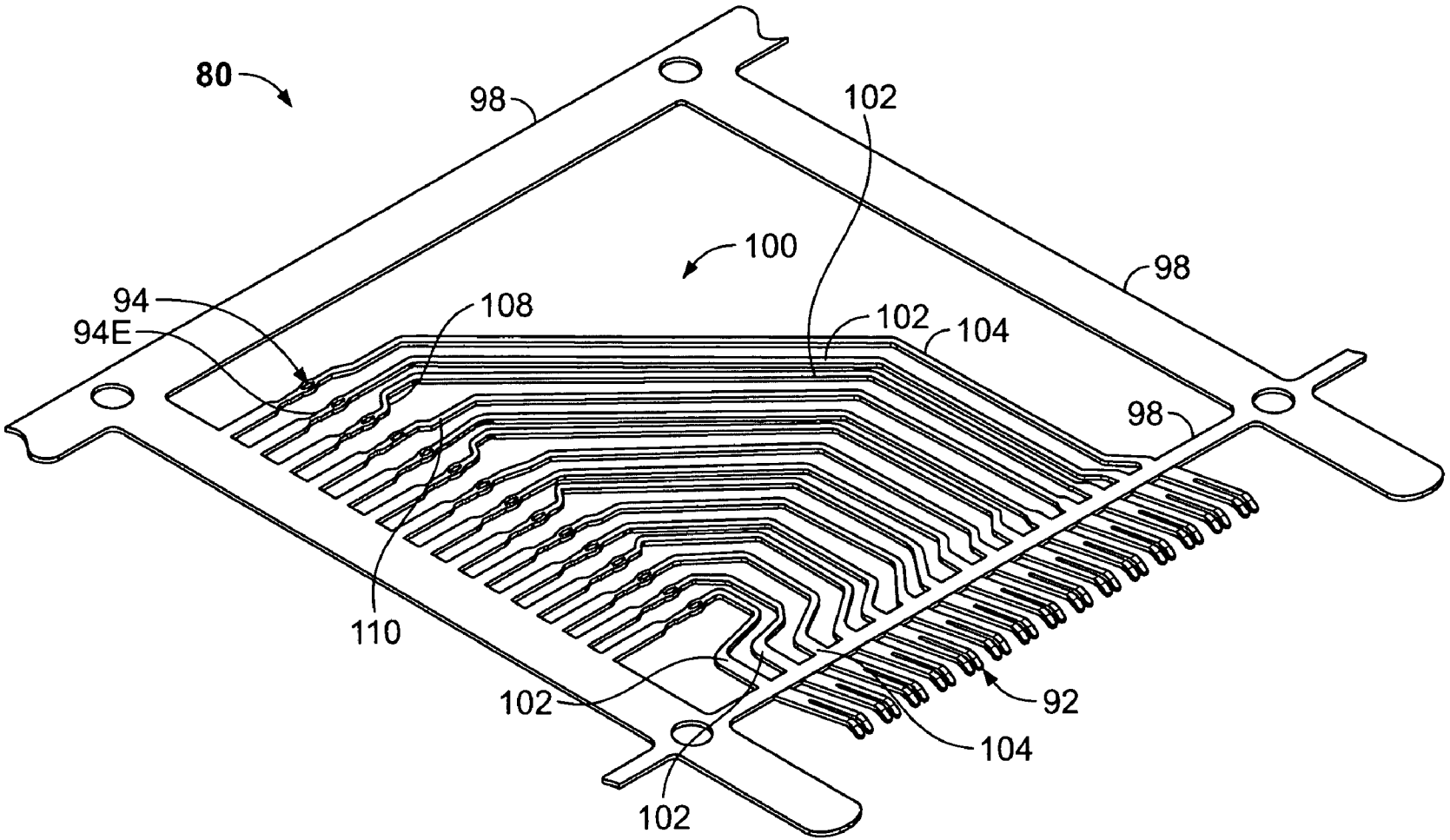
FIG. 6 is a perspective view of a contact lead frame formed in accordance with an exemplary embodiment of the present invention.

FIG. 6 illustrates a contact lead frame 80. The contact lead frame 80 is shown attached to carrier strips 98 which are removed when the contact lead frame 80 is assembled in the contact module 62. The contact lead frame 80 includes a plurality of conductive leads 100 terminating at one end with a mating contact 92 and terminating at the other end with a mounting contact 94. The contact lead frame 80 includes signal leads 102 and ground leads 104 arranged in one of first and second patterns. Each of the first and second patterns includes pairs of signal leads 102 and individual ground leads 104 arranged in an alternating sequence. In either pattern, the signal leads 102 are arranged in pairs with one ground lead 104 separating pairs of signal leads 102 from one another. When transmitting differential signals, it is desirable that the lengths of the signal paths for the signal pair be as closely matched as possible so as to minimize skew in the transmitted signal. In FIG. 6, where length differences between the signal leads 102 in a signal pair are sufficient to produce an unacceptable level of skew, a jog 108 is formed in the shorter of the signal leads 102 in the signal lead pair to add length to the shorter signal lead 102 of the signal lead pair. Some ground leads 104, such as ground lead 94E also are provided with a jog 110 that is configured to allow the ground lead 104 to be positioned to minimize imbalance between the ground lead 104 and the signal pair in the adjacent contact module 62 to which the ground lead 104 is coupled as will be described.

Figure 7:
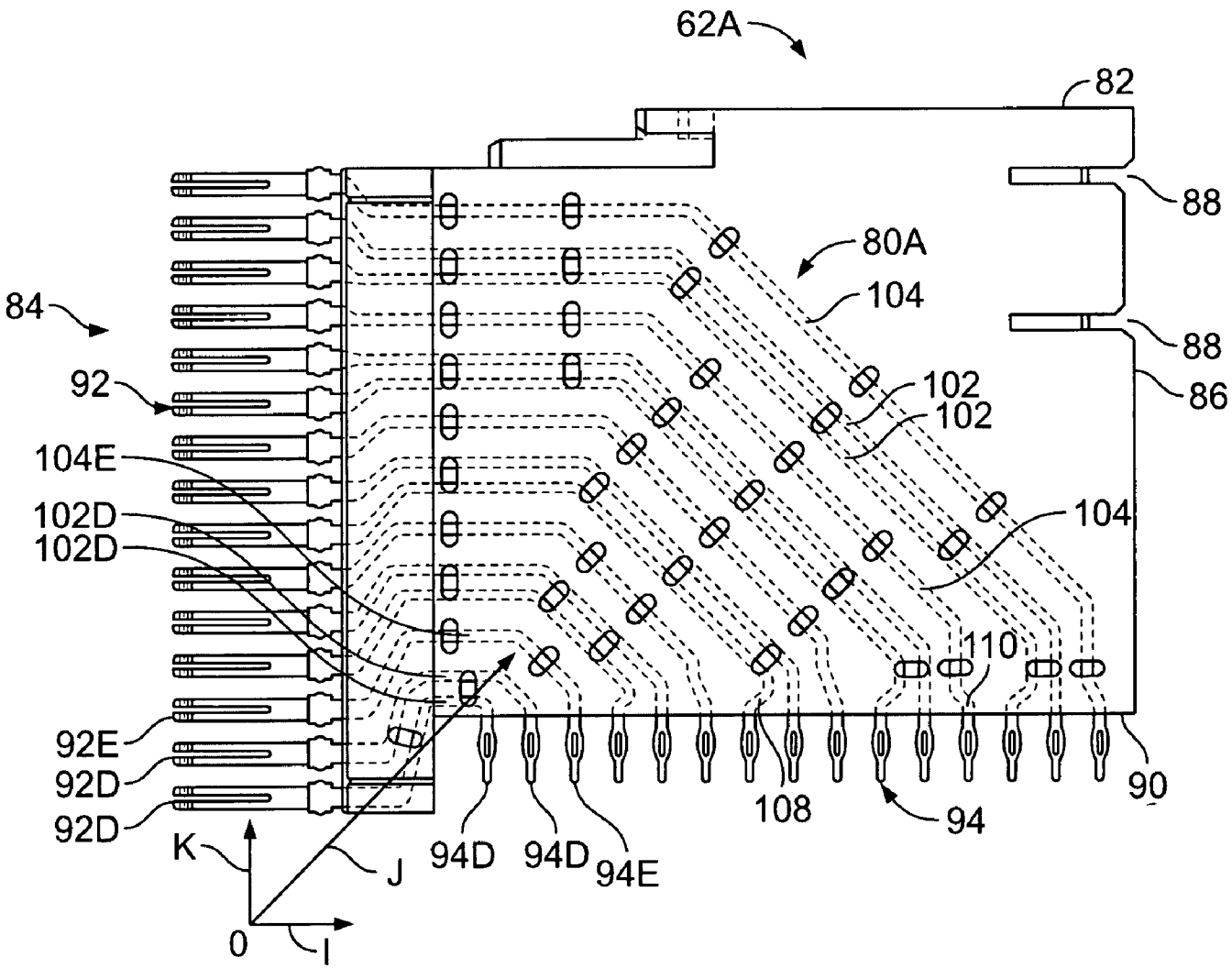
FIG. 7 is side view of a contact module A showing internal lead paths in phantom outline.

FIG. 7 illustrates a side view of a contact module 62A. In the receptacle connector 50 (FIG. 4), the contact modules 62 include signal leads and ground leads arranged in one of first and second alternating patterns and wherein the leads in adjacent lead frames, and consequently, the leads in adjacent contact modules, are arranged in different ones of the first and second patterns. The module 62A exhibits one of the patterns while the module 62B (FIG. 8) exhibits the other. FIG. 7 illustrates the lead frame pattern in the contact module 62A. The contact module 62A includes the contact module housing 82 in which there is encased a lead frame 80A having a first lead frame pattern. Each signal and ground lead 102, 104 has a mating end proximate the mating end 84 of the contact module 62A that culminates one of the mating contacts 92. Each signal and ground lead 102, 104 also has a mounting end proximate the mounting edge 90 of the contact module 62A that culminates with one of the mounting contacts 94. The pattern of the mating contacts 92 along the mating end 84 and the pattern of the mounting contacts 94 along the mating edge 90 both correspond to the pattern of the signal and ground leads 102, 104 through the contact module 62A as will be explained with reference to arrows I, J and K having a common origin O.

Starting at the origin O and proceeding through the contact module 62A in the direction of the arrow J, the first lead frame pattern is recognized as including a pair of signal leads 102D followed by the individual ground lead 104E. The pattern continues with pairs of signal leads 102 and individual ground leads 104 arranged in an alternating sequence wherein individual ground leads 104 separate pairs of signal leads 102.

Returning to the origin O and examining the mounting contacts 94, it is shown that the mounting contacts 94 exhibit a pattern along the direction of the arrow I that corresponds to the pattern of the signal and ground leads 102, 104 wherein a pair of signal mounting contacts 94D are followed by the individual ground mounting contact 94E. The pattern continues with pairs of signal mounting contacts 94D and individual ground mounting contacts 94E arranged in an alternating sequence wherein individual ground mounting contacts 94E separate pairs of signal mounting contacts 94D.

Likewise, the mating contacts 92, in the direction of the arrow K, starting from the origin O, are arranged in a pattern wherein a pair of signal mating contacts 92D are followed by the individual ground mating contact 92E. The pattern continues with pairs of signal mating contacts 92D and individual ground mating contacts 92E arranged in an alternating sequence wherein individual ground mating contacts 92E separate pairs of signal mating contacts 92D.

Figure 8:
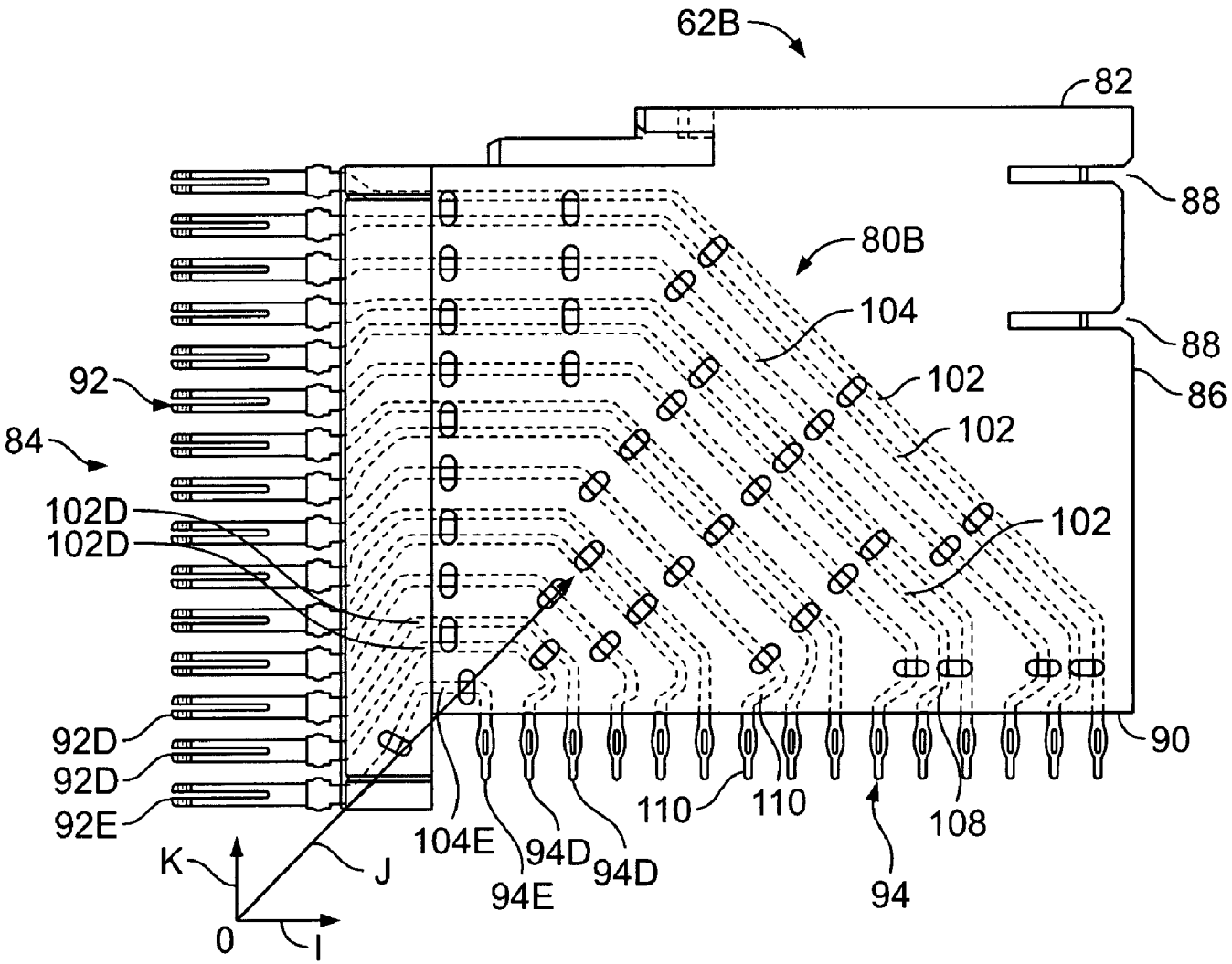
FIG. 8 is side view of a contact module B showing internal lead paths in phantom outline.

FIG. 8 illustrates the lead frame pattern in the contact module 62B. The contact module 62B includes the contact module housing 82 in which there is encased a lead frame 80B having the second lead frame pattern. Each lead 102, 104 has a mating end proximate the mating end 84 of the contact module 62B that culminates one of the mating contacts 92. Each lead 102, 104 also has a mounting end proximate the mounting edge 90 of the contact module 62B that culminates with one of the mounting contacts 94. The pattern of the mating contacts 92 along the contact module mating end 84 and the pattern of the mounting contacts 94 along the contact module mating edge 90 both correspond to the pattern of the contact leads 102, 104 through the contact module 62B as will be explained with reference to arrows I, J and K having a common origin O.

Starting at the origin O and proceeding through the contact module 62B in the direction of the arrow J, the first lead frame pattern is recognized as starting with an individual ground lead 104E followed by a pair of signal leads 102D. The pattern continues with individual ground leads 104 and pairs of signal leads 102 arranged in an alternating sequence wherein individual ground leads 104 separate pairs of signal leads 102.

Returning to the origin O and examining the mounting contacts 94, it is shown that the mounting contacts 94 exhibit a pattern along the direction of the arrow I that corresponds to the pattern of the leads 102, 104 wherein an individual ground mounting contact 94E is followed by a pair of signal mounting contacts 94D. The pattern continues with individual ground mounting contacts 94E and pairs of signal mounting contacts 94D arranged in an alternating sequence wherein individual ground mounting contacts 94E separate pairs of signal mounting contacts 94D.

Likewise, the mating contacts 92, in the direction of the arrow K, starting from the origin O, are arranged in a pattern wherein an individual ground mating contact 92E is followed by a pair of signal mating contacts 92D. The pattern continues with individual ground mating contacts 94E and pairs of signal mating contacts 94D arranged in an alternating sequence wherein individual ground mating contacts 92E separate pairs of signal mating contacts 92D.

With reference to FIGS. 7 and 8, when contact modules 62A and 62B are placed adjacent one another, the ground leads 104 in the contact modules 62A and 62B follow the path of and are approximately centered between the signal leads 102 in the adjacent contact module 62A, 62B to which the ground lead is coupled. In addition, when one of the signal leads 102 in a signal lead pair includes a jog 108, the ground lead 104 in an adjacent contact module 62A, 62B, that is coupled to the pair of signal leads also includes a jog 110 that is configured to allow the ground lead 104 to be positioned to minimize imbalance between the ground lead 104 and the signal pair in the adjacent contact module 62A, 62B to which the ground lead 104 is coupled.

For example, in FIG. 8, the second contact pair inward from the rearward edge 86 of the contact module 62B includes the shorter lead 102 having a jog 108. The jog is provided so that a length of the shorter lead 102 of the signal lead pair is approximately equal to a length of the other of the pair of signal leads 102 so as to minimize skew in the transmitted signal. This second pair of signal leads 102 in the module 62B is coupled with the second ground lead 104 (i.e. second from the rearward edge 86) in the contact module 62A shown in FIG. 7. The ground lead 104 includes a jog 110 that is configured to allow the ground lead 104 to be positioned to minimize imbalance between the ground lead 104 and the signal pair in the adjacent contact module 62B to which the ground lead 104 is coupled.

Figure 9:
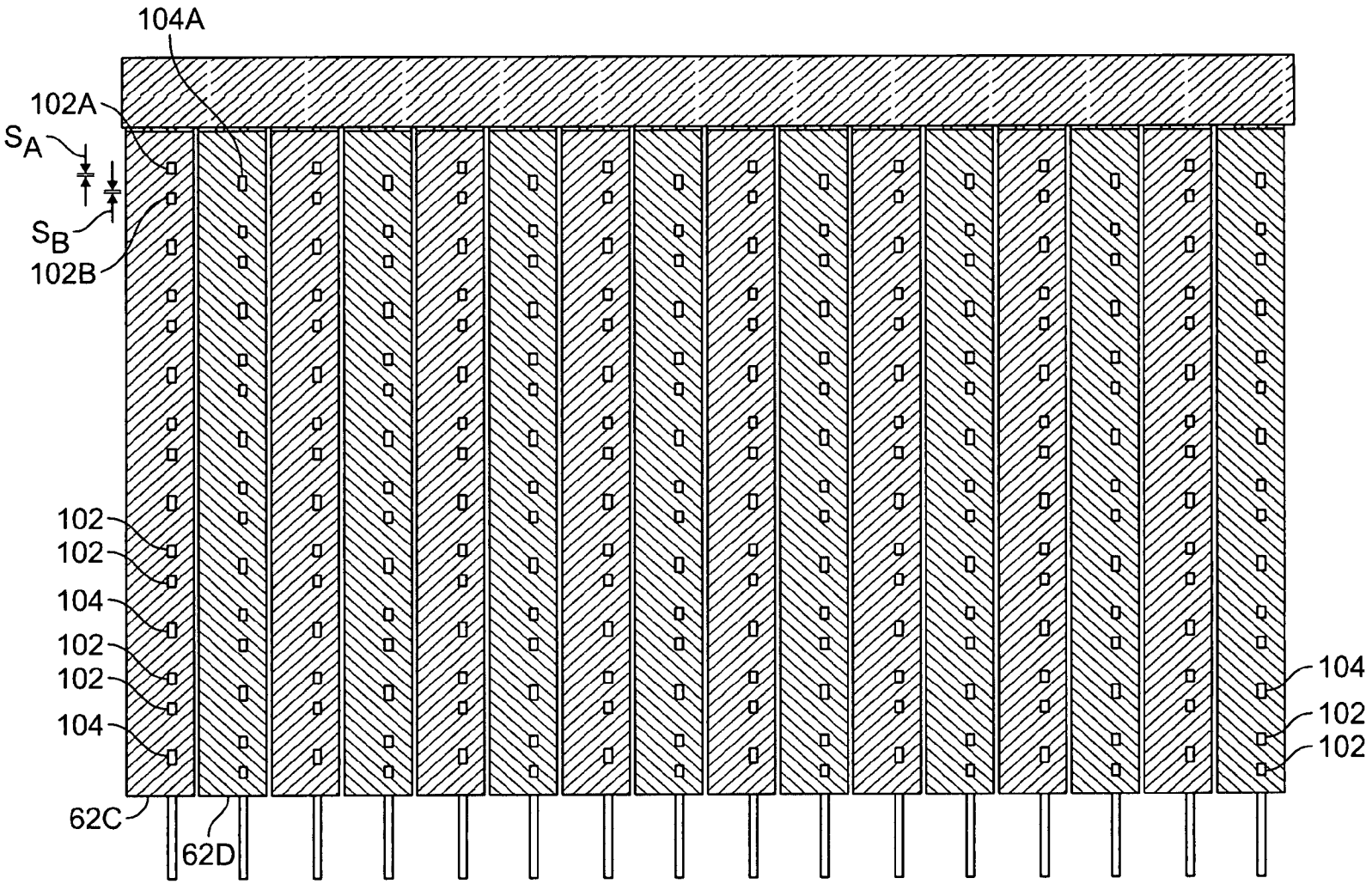
FIG. 9 is cross sectional view of the connector shown in FIG. 3 taken along the line B—B.

FIG. 9 illustrates a cross section of the receptacle connector 50 taken along the line B—B shown in FIG. 3. The cross section illustrates the relative positioning of the signal leads 102 and ground leads 104 in adjacent contact modules 62 in the receptacle connector 50. The signal leads 102A and 102B in the contact module 62C are coupled with the ground lead 104A in the adjacent contact module 62D. The signal lead 102A has a spacing $S_A$ between itself and the ground lead 104A. The signal lead 102B has a spacing $S_B$ between itself and the ground lead 104A. In order to reduce imbalance in the connector 50 it is desirable that the signal leads 102A and 102B be equally spaced from the ground lead 104A. The signal leads 102A and 102B and the ground lead 104A are positioned relative to each other such that the spacings $S_A$ and $S_B$ are substantially equal. That is, the ground lead 104A is spacially centered between the signal leads 102A and 102B, thereby reducing the imbalance in the receptacle connector 50.

The embodiments herein described provide a low cost connector for carrying differential signals. The connector provides a high density of interconnections through reduced contact spacing that is achieved by the elimination of ground shield plates on the contact modules. Imbalance in the connector is reduced by positioning ground leads with respect to signal lead pairs in an adjacent contact module so that the ground lead is spacially centered between a pair of signal leads.

While the invention has been described in terms of various specific embodiments, those skilled in the art will recognize that the invention can be practiced with modification within the spirit and scope of the claims.

What is claimed is:

1. An electrical connector comprising:

a housing holding first and second contact modules, said first contact module including a first contact lead frame having signal and ground leads arranged in a first pattern and extending along a first plane, said second contact module including a second contact lead frame having signal and ground leads arranged in a second pattern and extending along a second plane, said first and second patterns each including pairs of signal leads and individual ground leads arranged in an alternating sequence, and wherein each pair of signal leads in said first contact module is located adjacent and is coupled to, an adjacent ground lead in said second contact module, said adjacent, ground lead in said second contact module being substantially spatially centered between said pair of signal leads in said first contact module.

2. The connector of claim 1, wherein each said ground lead in said first contact module is equally spaced from a corresponding adjacent pair of said signal leads in said second contact module to reduce an imbalance in said connector.

3. The connector of claim 1, wherein at least one lead of one of said pair of signal leads includes a jog so that a length of said one lead of said pair of signal leads is approximately equal to a length of the other of said pair of signal leads.

4. The connector of claim 1, wherein at least one of said ground leads includes a jog that is configured to allow said at least one ground lead to be positioned to minimize an imbalance between said at least one ground lead and a signal pair in an adjacent one of said plurality of contact modules.

5. The connector of claim 1, wherein said first and second contact modules are held against one another by said housing such that said first and second contact lead frames are aligned parallel to one another within corresponding said first and second planes.

6. The connector of claim 1, said housing including a plurality of latch hooks and each of said first and second contact modules including a latch pocket, each said latch hook received in a corresponding said latch pocket when said first and second contact modules are received in said housing, said latch hooks and said latch pockets cooperating to retain said first and second contact modules in said housing, wherein said latch hooks and latch pockets are oriented to face laterally such that said second contact module inhibits the removal of said first contact module from said housing.

7. The connector of claim 6, wherein a first latch pocket on said first contact module is held in a latched position with a corresponding latch hook by said second contact module located adjacent said first contact module.

8. The connector of claim 1, wherein each of said first and second contact modules includes a single corresponding said first and second contact lead frame, respectively.

9. The connector of claim 1, wherein each of said first and second contact modules include a module housing that is over molded over and encases said first and second contact lead frames.

10. The connector of claim 1, wherein said first contact module has a forward mating end received in said housing, said forward mating end having signal and ground contacts joined to associated said signal and ground leads, said signal and ground contacts extending along a single row.

11. The connector of claim 1, wherein said first and second contact modules each include a single row of forward mating contacts received in said housing.

12. An electrical connector comprising:

a housing holding a plurality of contact modules, each said contact module containing a contact lead frame, said housing including a plurality of latch hooks and each said contact module including a latch pocket, each said latch hook received in said latch pocket of a respective contact module when said contact module is received in said housing, said latch hooks and said latch pockets cooperating to retain said contact modules in said housing, wherein said latch hooks and latch pockets are oriented to face laterally toward adjacent said contact modules such that each said contact module inhibits the removal of an adjacent contact module from said housing, wherein a first latch pocket on a first contact module is held, in a latched position with a corresponding latch hook on said housing, by a second contact module that is located adjacent to said first contact module.

13. The connector of claim 12, wherein each of said contact modules includes a forward mating end and an opposite rearward end, said rearward end configured to receive a tie bar to couple and align each said contact module to an adjacent contact module.

14. The connector of claim 12, wherein each said contact lead frame includes pairs of signal leads and individual ground leads, at least one of said ground leads including a jog that is configured to allow said at least one ground lead to be positioned to minimize an imbalance between said at least one ground lead and a signal pair in an adjacent one of said plurality of contact modules.

15. An electrical connector comprising:

a housing holding a plurality of contact modules, each said contact module containing a contact lead frame, said housing including a plurality of latch hooks and each said contact module including a latch pocket, each said latch hook received in said latch pocket of a respective contact module when said contact module is received in said housing, said latch hooks and said latch pockets cooperating to retain said contact modules in said housing, wherein said latch hooks and latch pockets are oriented to face laterally toward adjacent said contact modules such that each said contact module inhibits the removal of an adjacent contact module from said housing, wherein each said contact lead frame includes signal leads and ground leads arranged in one of a first and second patterns, said first and second patterns each including pairs of signal leads and individual ground leads arranged in an alternating sequence, and wherein each pair of signal leads is coupled to a ground lead in an adjacent contact module, said coupled ground lead in said adjacent contact module being substantially spatially centered between said pair of signal leads.

16. The connector of claim 15, wherein said contact modules are held by said housing in parallel planes, which each said contact lead frame aligned within a corresponding one of said parallel planes.

17. An electrical connector comprising:

a housing holding a plurality of contact modules, each said contact module containing a contact lead frame, said housing including a plurality of latch hooks and each said contact module including a latch pocket, each said latch hook received in said latch pocket of a respective contact module when said contact module is received in said housing, said latch hooks and said latch pockets cooperating to retain said contact modules in said housing, wherein said latch hooks and latch pockets are oriented to face laterally toward adjacent said contact modules such that each said contact module inhibits the removal of an adjacent contact module from said housing, wherein each said contact lead frame includes signal leads and ground leads arranged in one of a first and second patterns, said first and second patterns each including pairs of signal leads and individual ground leads arranged in an alternating sequence, and wherein each pair of signal leads is separated from another pair of signal leads by an individual ground lead.

18. An electrical connector comprising:

a housing holding a plurality of contact modules, each said contact module containing a contact lead frame, said housing including a plurality of latch hooks and each said contact module including a latch pocket, each said latch hook received in said latch pocket of a respective contact module when said contact module is received in said housing, said latch hooks and said latch pockets cooperating to retain said contact modules in said housing, wherein said latch hooks and latch pockets are oriented to face laterally toward adjacent said contact modules such that each said contact module inhibits the removal of an adjacent contact module from said housing, wherein each said contact lead frame includes pairs of signal leads and individual ground leads, at least one lead of one of said pair of signal leads including a jog so that a length of said one lead of said pair of signal leads is approximately equal to a length of the other of said pair of signal leads.

* * * * *